US007819829B1

(12) United States Patent
Chandran

(10) Patent No.: US 7,819,829 B1
(45) **Date of Patent: *Oct. 26, 2010**

(54) THROMBUS PREVENTION APPARATUS AND METHODS

(76) Inventor: George Chandran, 1210 Sigma Chi Rd. NE, Albuquerque, NM (US) 87106

( * ) Notice: Subject to any disclaimer, the term of this patent is extended or adjusted under 35 U.S.C. 154(b) by 0 days.

This patent is subject to a terminal disclaimer.

(21) Appl. No.: 11/690,701

(22) Filed: Mar. 23, 2007

Related U.S. Application Data

(63) Continuation of application No. 10/713,408, filed on Nov. 13, 2003, now Pat. No. 7,207,959.

(60) Provisional application No. 60/425,944, filed on Nov. 13, 2002.

(51) Int. Cl.
*A61H 19/00* (2006.01)

(52) U.S. Cl. ..... 601/149; 601/150; 601/151

(58) Field of Classification Search ..... 601/149–152, 601/46, 48

See application file for complete search history.

(56) References Cited

U.S. PATENT DOCUMENTS 5,117,812 A * 6/1992 McWhorter ..... 601/149
5,669,872 A * 9/1997 Fox ..... 601/152
5,730,136 A * 3/1998 Laufer et al. ..... 600/454
6,007,559 A * 12/1999 Arkans ..... 606/201
6,064,912 A * 5/2000 Kenney ..... 607/48

* cited by examiner

*Primary Examiner*—Michael A. Brown
(74) *Attorney, Agent, or Firm*—Janeen Vilven Peacock Myers, P.C.

(57) ABSTRACT

An apparatus and methods for the prevention or minimization of lower extremity venous thrombosis comprising an impedance component disposed at the proximal end of the lower extremity and a compression component disposed at the distal end of the lower extremity. The proximal impedance component is activated to impede return venous blood flow, preferably on the femoral vein, until blood volume in the lower extremity is maximized. In response to deactivation of the proximal compression component, the distal compression component is activated to assist return venous blood flow. The apparatus and methods enhance blood circulation in the lower extremity by increasing washout of stagnant blood from the lower extremity, particularly from the venous sinuses and valve cusps where thrombosis tends to form.

18 Claims, 4 Drawing Sheets

THROMBUS PREVENTION APPARATUS AND METHODS

CROSS-REFERENCE TO RELATED APPLICATIONS

This application is a continuation application of U.S. patent application Ser. No. 10/713,408, entitled "Thrombus Prevention Apparatus and Methods", to George Chandran, filed on Nov. 13, 2003, which claims the benefit of the filing of U.S. Provisional Patent Application Ser. No. 60/425,944, entitled "Medical Devices", filed on Nov. 13, 2002, and the specifications and claims thereof are incorporated herein by reference.

BACKGROUND OF THE INVENTION

1. Field of the Invention (Technical Field):

The present invention relates to methods and vascular assist apparatuses for preventing the development of venous thrombosis of the lower extremities.

2. Description of Related Art

Note that the following discussion refers to a number of publications by author(s) and year of publication, and that due to recent publication dates certain publications are not to be considered as prior art vis-à-vis the present invention. Discussion of such publications herein is given for more complete background and is not to be construed as an admission that such publications are prior art for patentability determination purposes.

Lower extremity venous thrombosis and pulmonary embolism is a significant cause of mortality and morbidity in patients. The condition arises as a result of inadequate circulation in sedentary, hospitalized patients leading to stagnation of blood and formation of thrombi in the veins, particularly in the venous sinuses and valve cusp areas.

Sequential and non sequential compression devices are known to alleviate the condition. Generally, these devices employ a short period of compression followed by a cycle of decompression to increase flow in the veins. For example, in one device comprising an extremity garment, chambers within the garment are sequentially inflated from ankle to knee (or mid thigh) to a maximum pressure of 45-50 mm Hg at the ankle, 35 mm Hg at the calf, and 30 mm at the thigh. Cycles of compression followed by relaxation are employed, such as a duration of compression of 11 seconds with a 60-second relaxation period between compressions.

Several patents disclose devices and methods to assist vascular circulation. For example, U.S. Pat. No. 6,007,559 discloses a "vascular assist device" in which statis pressure is graduated, such as from the ankle to the hip. In one embodiment, there are two separate cuffs.

U.S. Pat. No. 5,117,812 discloses separate "segments" for applying pressure about the leg in an inflation or compression cycle applying pressure first to the distal segment of the leg followed by pressure to the proximal segment. U.S. Pat. No. 5,014,681 discloses an intermittent pressure sleeve. U.S. Pat. No. 4,841,956 discloses a two-compartment cuff, with a proximal calf pump operated first followed by operation of the distal calf pump. Other patents disclosing compression devices include U.S. Pat. Nos. 4,865,020, 5,022,387, 5,109,832, 5,186,163, 6,231,532 and 6,440,093.

U.S. Pat. No. 2,140,898 discloses the use of a cuff positioned at the upper thigh to intermittently apply pressure and restrict return blood flow. The stated result is that an active vaso-dilation of the arteries occurs causing a stated increase in arterial circulation.

The prior art is directed at stimulating fluid flow in an attempt to move blood in a manner that will prevent the formation of thrombi. Some devices, such as sequential-TEDS devices, such as those sold by Kendall Co., are marketed and used to achieve sequential compression, by sequentially compressing a portion of the leg, such as the calf and/or lower thigh, in a sequential manner starting at the most distal point and sequentially proceeding to the proximal. Other devices, such as the PlexiPulse® pneumatic compression device (KCI USA), apply non-sequential compression, such as to the foot and/or calf. However, in many patients, refill of the veins is inefficient, and none of the prior art addresses the problem such inefficient refill presents in allowing blood to remain stagnant in various parts of the venous system—particularly in the sinuses and valve cusps. In such patients, the blood pooling or stasis is such that the pressure produced by devices of the prior art cannot alone fully flush the venous system. Therefore, there is a need for devices and methods to fully flush the venous system, particularly the valve cusp areas where thrombus usually originates and blood flow is the least.

BRIEF SUMMARY OF THE INVENTION

The present invention includes methods and an apparatus for enhancing return blood flow in the lower extremities to prevent thrombosis in a human body experiencing diminished and stagnant venous blood flow. The apparatus includes an impedance component disposed at the proximal end of the lower extremity that when activated impedes return venous blood flow for a short period of time, thereby providing for an increase in blood volume in the lower extremity. The apparatus further includes a compression component disposed at the distal end of the lower extremity that is activated in response to the deactivation of the impedance component such that the volume and velocity of return blood flow is enhanced.

The impedance component may include cuffs, clamps, pistons, bulbs, or any other device capable of restricting return blood flow. The impedance component is activated via mechanical, pneumatic, electrical, or electronic systems.

The compression component may include cuffs, clamps, pistons, bulbs or any device capable of assisting return venous blood flow. It is activated via mechanical, pneumatic, electrical, or electronic systems.

The impedance component is activated for between approximately 10 and 60 seconds, optimally between approximately 10 and 30 seconds, and for preferably approximately 20 seconds, during which time maximum venous fill volume is held for a period, preferably approximately 10 seconds. The compression component is activated in response to deactivation of the impedance component. The impedance component is activated to exert a pressure of between approximately 20 and 60 mm Hg, optimally between about 30 and 40 mm Hg, preferably about 30 mm Hg. The impedance component is preferably activated at a pressure sufficient to substantially or effectively cease venous return blood flow without significantly impeding arterial blood flow. The compression component is activated to exert pressure of between about 40 and 80 mm Hg, preferably about 50 mm Hg.

A control unit may be employed to synchronize the activation and deactivation of the impedance component and the compression component. A sensor unit may be provided, which may be disposed on the lower extremity distal to the impedance component, may form a part of the compression component, or may alternatively form a part of the impedance component, to monitor blood volume and provide feedback to the control unit. The control unit deactivates the impedance component and activates the compression component when a predetermined blood volume is achieved. In one embodiment, the control unit deactivates the impedance component and activates the compression component in response to a signal from the sensor unit. The sensor unit may comprise a strain-gauge plethysmography unit, a pressure transducer, an impedance plethysmography unit or a photoplethysmography unit.

The apparatus for enhancing return blood flow in the lower extremities to prevent thrombosis in a human body experiencing diminished and stagnant venous blood flow. This includes a means for impeding venous flow in the femoral vein at the proximal end of the lower extremity, a means for compressing at least a portion of the distal end of the lower extremity, and a controller for controlling operation of both means. Such apparatus further optimally includes a sensor for determining the maximal venous fill and providing an input to the controller.

The invention also includes a method for enhancing return blood flow in a lower extremity to prevent thrombosis. The method includes impeding the venous blood flow at the proximal end of the lower extremity for a defined period of time thereby increasing venous fill in the lower extremity, and thereafter compressing a portion of the distal end of the lower extremity. The compression is initiated in relation to the release of impedance of the venous blood flow at the proximal end of the lower extremity. This method further comprises the step of determining the maximal venous fill in response to impeding the venous blood flow. Compression of a portion of the distal end of the lower extremity is initiated before, simultaneous with, or after release of, impedance of the venous blood flow at the proximal end of the lower extremity. The defined period of time for impedance optimally includes maintenance of maximal venous fill for a defined period of time.

A primary object of the present invention is to prevent the development of thrombosis by more effectively washing out the stagnant blood in the veins of the lower extremities.

A primary advantage of the present invention is that it provides for more complete blood return, particularly in the venous sinuses and valve cusp areas.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention provides an apparatus and methods for the prevention and minimization of venous thrombosis in the lower extremities. The present invention recognizes the need to fully flush the venous system and that the required improvement in blood flow is accomplished by first increasing the blood volume in the lower extremity so that when return flow is assisted, there results a more thorough washing out of the stagnant blood from the venous sinuses and valve cusps. This is accomplished through the impedance of return blood flow, thereby providing maximum venous blood volume, and compression of the lower extremities to assist blood flow. The impedance component is located at the upper thigh and first activated to impede blood flow, such as at the femoral vein, until maximal venous fill is achieved in the leg. The impedance component is then deactivated to allow normal return blood flow, and in conjunction therewith, the compression component located at the distal end of the leg is activated. The compression component may be a sequential compression device.

Both the impedance component and the compression component may be operated and activated by the same system, or optionally may each be operated by separate systems. A controller, such as a controller including a control logic circuit, controls the activation and operation of both components. The controller or control logic circuit may be integrated into the current design of pressure systems, and can provide for operating pressure and/or timed cycle parameters. The control logic circuit may be programmable, or may be fixed. User input parameters, including, for example, time, feedback sensor parameters, pressure at the femoral vein, pressure of the sequential compression component, and the like may be provided, with input by conventional means, including input by means of a keyboard, numerical keypad, selectable switches and the like.

Figure 1A:
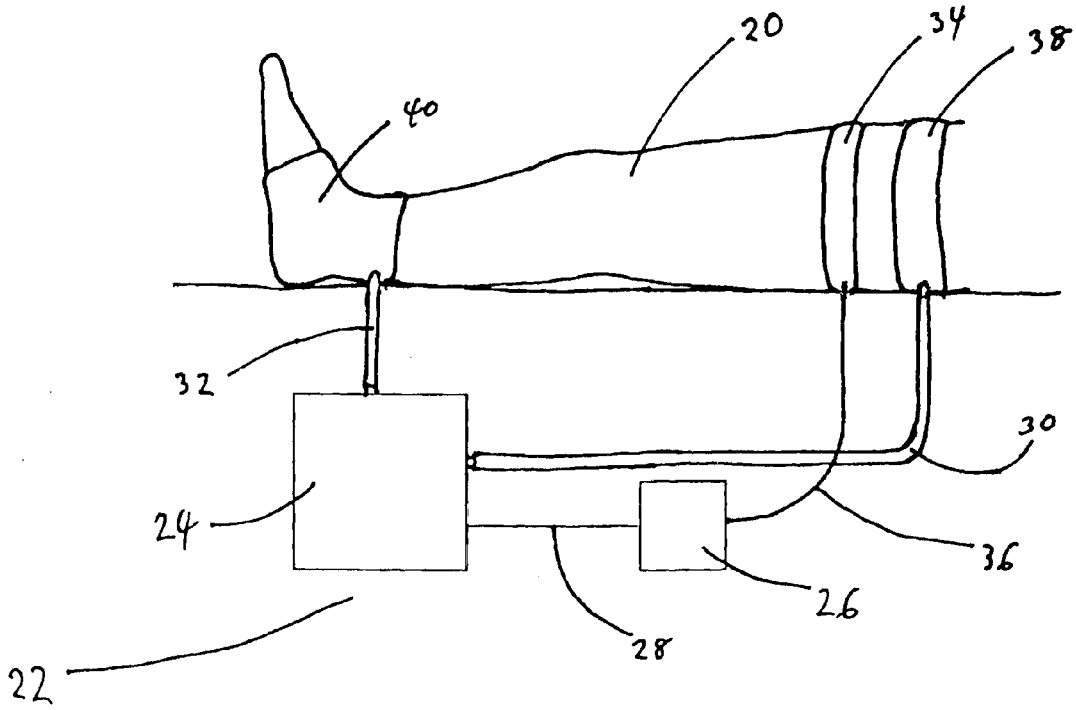
FIG. 1*a* is a view of the thrombus prevention apparatus of this invention disposed on a leg.
Figure 1B:
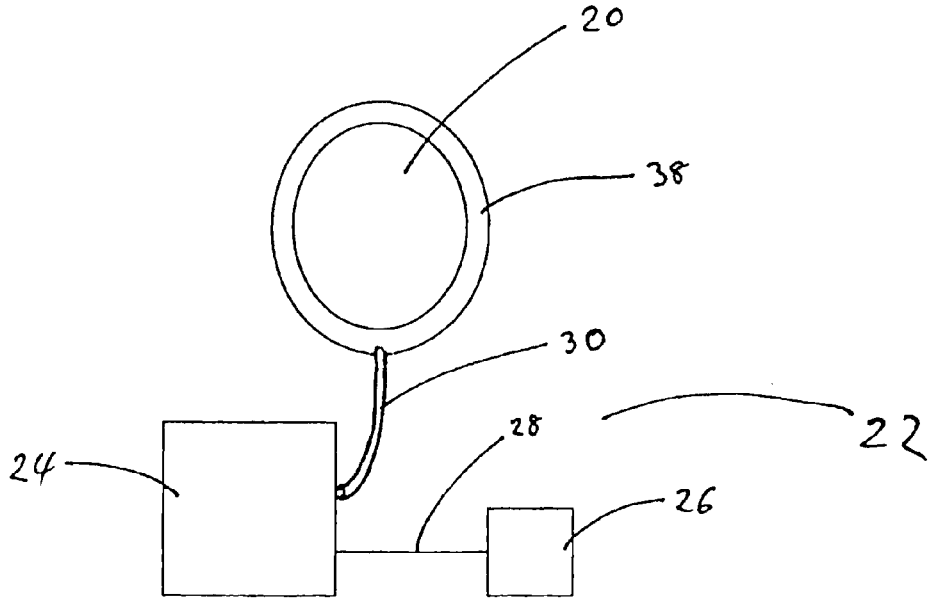
FIG. 1*b* is a cross section view of the thrombus prevention apparatus of this invention comprising an impedance cuff disposed on a leg.

Turning now to the figures, FIGS. 1*a* and 1*b* show a preferred embodiment of the present invention. The apparatus 22 of the present invention comprises two components capable of exerting pressure to the leg 20 to which they are disposed. In a preferred embodiment, the devices comprise compression cuffs. Impedance cuff 38, providing an impedance component, is disposed on the proximal end of the leg and functions to impede venous return blood flow thereby providing for an accumulation of blood in the leg 20. Impedance cuff 38 is preferably disposed in a position wherein impedance cuff 38 can exert pressure on the femoral vein. The exerted pressure may vary from between approximately 20 to 60 mm Hg, optimally from between approximately 30 to 40 mm Hg, preferably 30 mm Hg, such that return venous blood flow is stopped or substantially stopped without significantly compromising arterial blood flow down to the lower extremity and without causing discomfort to the patient.

A pressure inducing apparatus 24 activates impedance cuff 38 by inflating impedance cuff 38 through the use of a gas or liquid delivered to impedance cuff 38 via a connector 30. By activating impedance cuff 38, return venous blood flow is impeded thereby providing for increased venous fill in the leg 20. When sufficient venous fill is achieved, impedance cuff 38 is deactivated by deflating it. The activation/deactivation is cycled continuously and may be timed through the use of a controller 26. The impedance cuff 38 is activated for between approximately 10 and 60 seconds, optimally for between approximately 10 and 30 seconds, and for preferably approximately 20 seconds during which time maximum registered volume is held for preferably approximately 10 seconds.

Alternatively, the controller 26 may activate/deactivate impedance cuff 38 in response to a feedback signal from a sensor 34 that is disposed on the leg 20 in a position distal to impedance cuff 38. Sensor 34 may signal when sufficient venous fill is achieved so that impedance cuff 38 may be deactivated. As in the timed cycle, impedance cuff 38 is activated for preferably approximately 10 seconds following peak venous fill, then deactivated.

An example of a feedback sensor unit comprises a strain-gauge plethysmography device. Such devices are typically used as diagnostic tools through their ability to monitor blood flow. For purposes of the present invention, such a device is used to measure the change in blood volume as a function of change in the diameter of a leg. Following the impedance of blood flow, the device will register an increase in the diameter of the leg until maximum venous fill is achieved. The information is delivered to the controller 26. The strain-gauge plethysmography device may form a part of the impedance component, such as impedance cuff 38, or may be located at any distal position on the extremity, including as a part of a distal compression component. A pressure transducer, as disclosed in U.S. Pat. Nos. 6,231,532 and 6,440,093, may similarly be employed.

Alternative feedback sensor units may similarly be employed. In one embodiment, impedance plethysmography is employed, wherein the change in blood volume, such as venous blood volume, is measured as a function of change in electrical impedance. Thus a small amount of alternating current can be passed through the body segment, such as a lower leg extremity. Typically for impedance plethysmography four electrodes are employed, arrayed along the leg, with two middle electrodes that detect a voltage, with the placement of the electrodes defining a measurement segment. The outer electrodes are used to emit a small alternating current required to measure the impedance. The electrodes may be stripe electrodes, electrocardiogram electrodes, or alternative forms of electrodes, and may be associated with or form a part of another component of the system, such as a sequential compression component forming a distal compression device. Thus the measurement or middle electrodes may be integrated into a sequential compression component or other distal compression component.

Yet another alternative feedback sensor unit, a photoplethysmography unit may be employed, the unit including a non-visible infrared light emitter, such as an LED, and a photosensor. Light absorbance is a function of blood volume in the skin, and thus blood volume changes are determined by measuring the reflected light and using the optical properties of tissue and blood. The photoplethysmography detection unit, also sometimes called a light reflection rheography unit, may be positioned along the extremity, such as the leg, and may, for example, be associated with or form a part of another component of the system, such as sequential compression component forming a distal compression component. Thus the LED emission and detection devices may be integrated into the sequential compression component or other distal compression component.

In response to deflation of impedance cuff 38, compression cuff 40, providing a compression component, disposed on the distal end of leg 20, is activated and functions to exert sufficient pressure to the leg 20 to push blood up the leg 20 toward the proximal end thereby enhancing return blood flow. Compression cuff 40 may be activated simultaneously with deactivation of impedance cuff 38, or may be activated shortly prior to or after deactivation of impedance cuff 38. Thus compression cuff 40 activation is responsive to impedance cuff 38 deactivation, whether such activation is simultaneous with deactivation, or occurs in some relationship to deactivation, such as prior thereto or subsequent thereto. The exerted pressure may vary from between approximately 40 to 80 mm Hg, preferably about 50 mm Hg, such that return venous blood flow is assisted without causing discomfort to the patient. However, higher pressures may be employed, including pressures up to about 200 mm Hg.

Compression cuff 40 is preferably activated by apparatus 24 which sends a gas or fluid to compression cuff 40 via a connector 32. Alternatively, an apparatus in addition to that controlling impedance cuff 38 may activate compression cuff 40. The activation of compression cuff 40 is preferably controlled by controller 26, but a separate controller may be employed. The controller 26 is connected to, and sends signals to, apparatus 24 via a connector 28. Notwithstanding that compression cuff 40 may be activated a few seconds prior to, or after, deactivation of impedance cuff 38, it is understood that venous blood volume is preferably maximized in the leg 20 before impedance cuff 38 is deactivated, and compression cuff 40 is preferably not activated until blood volume is maximized. The coordinated activation and deactivation of impedance cuff 38 and compression cuff 40 causes an increase of blood volume in the leg 20 so that when impedance cuff 38 is deactivated, blood flow is greatly enhanced and a more complete wash out of stagnant blood, particularly in the venous sinuses and valve cusps, is achieved.

As described above, in a preferred embodiment the compression components comprise cuffs 38, 40 that are inflatable and connected to each other via a system that provides that they be appropriately timed to inflate and deflate. Compression cuff 40 may consist of a sequential compression component, as known in the art. The compression cycle can be repeated continuously. Impedance cuff 38 can be a comparatively narrow band cuff, given that the function is to decrease return blood flow. Compression cuff 40 covers a significantly larger area, including, for example, substantially the entire lower leg and ankle region.

As described above, a timing mechanism may be employed to time venous fill (activation of impedance cuff 38 followed by deactivation of compression cuff 40) and emptying (deactivation of impedance cuff 38 and activation of compression cuff 40). Various cycles may be employed. Alternative to the use of a sensor 34 to provide feedback to the compression apparatus 24 as described above, the apparatus 22 may further include input data from a patient cardiac monitor.

As described above, impedance cuff 38 may optionally be operated by the same apparatus 24 that operates compression cuff 40, and by a controller 26 comprising a control logic circuit for operating both. The controller 26 may be integrated into the current design of pressure systems, and can provide for both traditional operating pressure and timed cycle parameters.

Figure 2:
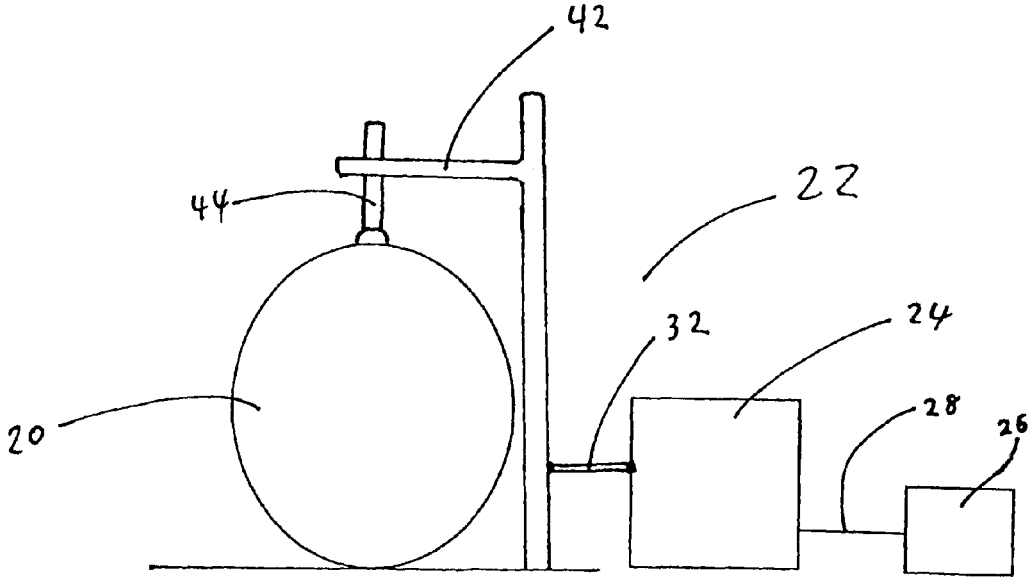
FIG. 2 is a cross section view of the thrombus prevention apparatus of this invention comprising an impedance clamp disposed on a leg.

In another embodiment, exemplified by FIG. 2, the thrombus prevention apparatus 22 comprises an impedance clamp 42 with a contact component 44 capable of applying sufficient pressure to an area of the leg to impede return blood flow. The activation/deactivation cycles are performed as in the embodiment described above. Clamp 42 is activated by apparatus 24 via a connector 32. Apparatus 24 also activates/deactivates a compression component as disclosed above and as shown in FIGS. 1*a* and 1*b*. Controller 26 is connected to apparatus 24 via connector 28 and times the cycles or controls the apparatus 22 in response to feedback via sensor unit 34.

Figure 3:
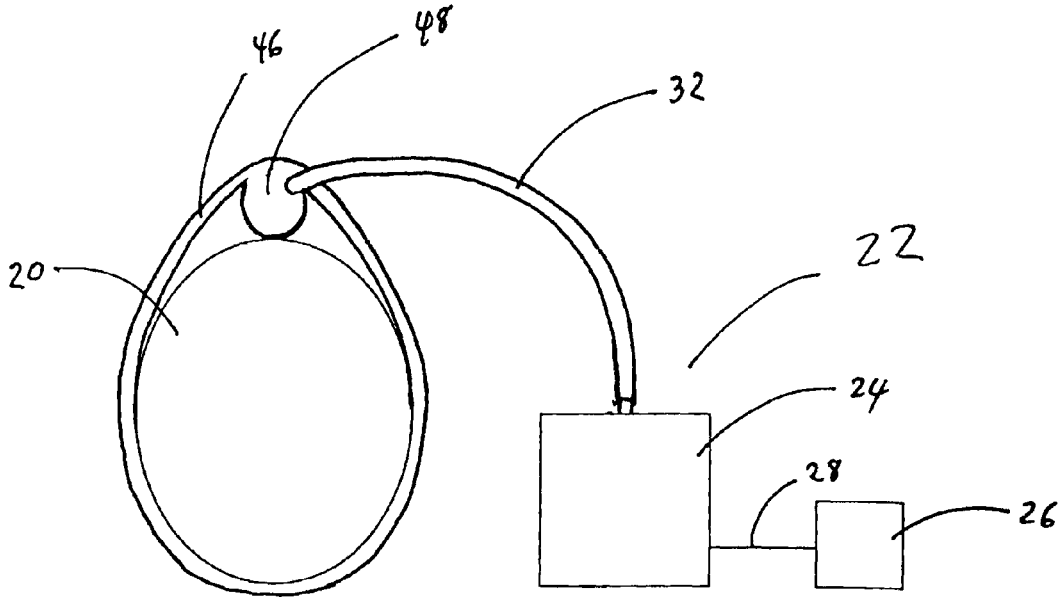
FIG. 3 is a cross section view of the thrombus prevention apparatus of this invention comprising an impedance bulb disposed on a leg.

In another embodiment, exemplified by FIG. 3, the thrombus prevention apparatus 22 comprises an impedance component 46 with an inflatable bulb 48 capable of applying sufficient pressure to the leg to impede return blood flow. The activation/deactivation cycles are performed as in the embodiments described above. Bulb 48 is activated by apparatus 24 via a connector 32. Apparatus 24 also activates/deactivates a compression component as disclosed above and as shown in FIGS. 1*a* and 1*b*. Controller 26 is connected to apparatus 24 via connector 28 and times the cycles or controls the apparatus 22 in response to feedback via sensor 34.

It may thus be seen that the impedance component may be positioned with respect to the femoral vein by any means known in the art. Thus it may be a cuff which encircles the leg. It may be a strap encircling the leg with an impedance component positioned with respect to the femoral vein. However, for many applications it is preferred that the appliance not encircle the leg. For example, in the event of hip surgery such encircling would result in patient discomfort. Thus the compression or impedance component may be positioned relative to the femoral vein by means of a ring appliance, a c-shaped appliance as shown in FIG. 2, a square-shaped appliance, external fixation to another component, such as a bed frame, or the like.

The impedance component may be activated by means of a pneumatic system, such as a bulb responsive to increased air pressure. However, other embodiments are possible and contemplated, including a pressure activated piston and cylinder arrangement, an electromechanical device, a spring-activated device, or the like. The portion of the impedance component in contact with the patient leg proximal the femoral vein may include a pad, foot or other arrangement designed to increase patient comfort.

The distal compression device, for augmenting venous blood emptying, may be of any type known in the art. For example, it may provide compression to the foot and ankle, as provided in the PlexiPulse® device. It may be a sequential device, providing graduated and sequential pressure, from the distal to the proximal. The distal compression component may compress the foot, the ankle, the calf, the lower thigh or any combination or permutation thereof.

The control unit is, in one preferred embodiment, combined with the motive element for the operation of the impedance component and the compression component, such as for example compressed air. The control unit may simply comprise a timing mechanism or means, preferably with user adjusted parameters, such as the total cycle length, the length of time of activation of the impedance component, the maximal pressure of the impedance component, the relationship between deactivation of the impedance component and activation of the compression component, such as simultaneous or a fixed time before or after, the length of time and rate of compression of the compression component, the maximal compression of the compression component, the rest period before a cycle repeat, and the like. In a particularly preferred embodiment, the control unit includes an input from a sensor unit, with the apparatus further including the sensor unit. By this means, actual maximal venous fill volume may be determined, and maintained for a fixed period, before initiation of the deactivation/activation cycle.

It may further be seen that the maximum blood velocity is related to two factors: deactivation of the impedance component and activation of the compression component. By varying the temporal relationship of the deactivation/activation events, it is possible to adjust parameters such as maximal blood velocity, length of time of increased blood velocity, or the like, in order to obtain results appropriate to the patient. In one embodiment, the control unit comprises components for determining such parameters, and for controlling response in relationship to such parameters.

In one study, pressure was measured using a directional Doppler ultrasound velocity detector with the probe adjusted over the axial stream of the popliteal vein. A conventional PlexiPulse® foot compression wrap was employed. The use of the method of the invention resulted in a significant increase in maximum blood velocity, often by a factor of 2. Patient discomfort did not increase. The maximum blood velocity obtained with impedance of the femoral vein for a period to permit maximal blood volume, followed by simultaneous release of the impedance of the femoral vein and activation of the PlexiPulse® compression device, resulted in significantly greater blood velocity than that obtained with either impedance of the femoral vein alone or lower extremity compression alone.

Figure 4A:
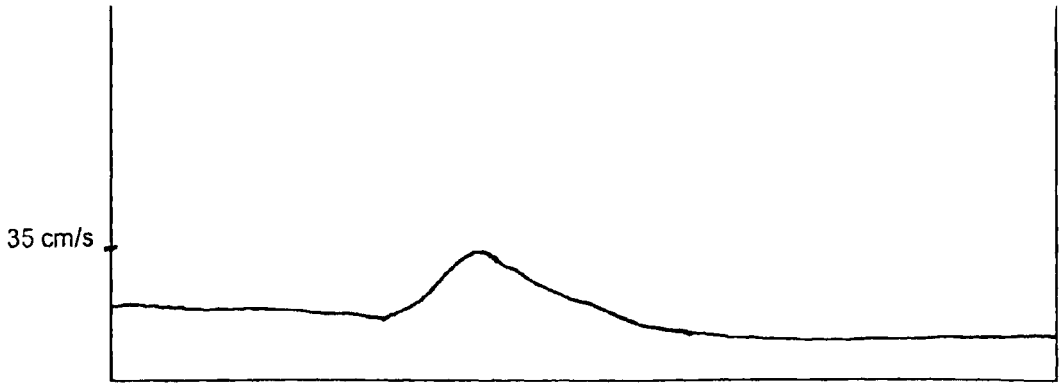
FIG. 4*a* is a graph illustrating the effect on venous blood flow with a distal compression device alone.
Figure 4B:
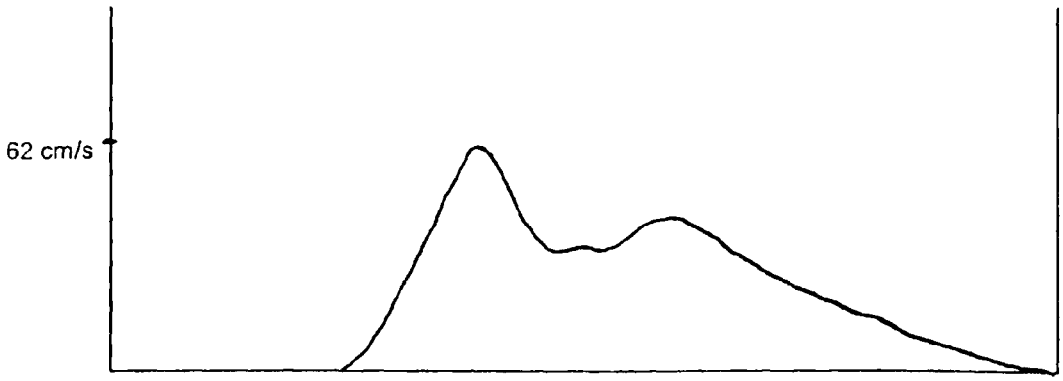
FIG. 4*b* is a graph illustrating the effect on venous blood flow with a distal compression device and employing the method of the invention, with impedance of venous return and simultaneous deactivation of impedance and activation of distal compression.

In another study, a sequential-TEDS compression device was employed in combination with impedance of the femoral vein. Doppler ultrasound, with the probe over the axial stream of the femoral vein, was used to determine velocity. As shown in FIG. 4*b*, the maximum velocity with impedance at the femoral vein, with simultaneous activation of the sequential-TEDS compression device, was almost twice that obtained with only the sequential-TEDS device, as shown in FIG. 4*a*. In FIGS. 4*a* and 4*b*, the x-axis is time and the y-axis is velocity. Thus use of compression alone using the sequential-TEDS resulted in a maximum velocity of 35 cm/s, while impedance at the femoral vein, with simultaneous release of impedance and activation of sequential compression, resulted in a maximum velocity of 62 cm/s.

It is apparent from the above description that the impedance component may alternatively comprise any embodiment capable of impeding return venous blood flow, preferably by applying pressure to the femoral vein, and that the compression component may alternatively comprise any embodiment capable of assisting the venous return blood flow from the distal end of the lower extremity.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus for enhancing return blood flow in a lower extremity to prevent thrombosis in a human body comprising:

a single impedance component disposed at the proximal end of the lower extremity that when activated impedes return venous blood flow by compressing a vein, thereby increasing venous fill in the lower extremity;

a single compression component disposed at the distal end of the lower extremity that is activated in response to deactivation of said impedance component and compresses at least a portion of the lower extremity such that return venous blood flow is enhanced;

wherein the leg between the impedance component and the compression component is exposed to allow for calf diameter expansion; and a controller in communication with the impedance component and the compression component wherein the controller comprises a control logic circuit programmed to inflate said impedance component to impede return venous blood flow thereby increasing venous fill in the lower extremity and programmed to deactivate said impedance component by deflating said impedance component when the lower extremity is substantially filled; and said control logic circuit programmed to activate said compression component in response to deactivation of said impedance component to compress the lower extremity thereby pushing blood toward the proximal end of the lower extremity thereby enhancing return blood flow and emptying venous blood in the lower extremity.

2. The apparatus of claim 1 wherein said impedance component comprises a component selected from the group consisting of cuffs, clamps, pistons, bulbs, and a combination of the foregoing.

3. The apparatus of claim 1 wherein said impedance component is activated via mechanical, pneumatic, electrical, or electronic systems.

4. The apparatus of claim 1 wherein said compression component comprises a component selected from the group consisting of cuffs, clamps, pistons, bulbs, sequential compression segments and a combination of the foregoing.

5. The apparatus of claim 1 wherein said compression component is activated via mechanical, pneumatic, electrical, or electronic systems.

6. The apparatus of claim 1 wherein said compression component is disposed at a portion of the lower extremity comprising a location selected from the group consisting of the foot, the ankle, the calf, the lower thigh and a combination of the foregoing.

7. The apparatus of claim 1 wherein said impedance component is activated until blood volume in the lower extremity is maximized, and said compression component is activated in response to deactivation of said impedance component.

8. The apparatus of claim 1 wherein said impedance component is activated to exert a pressure of between approximately 20 and approximately 60 mm Hg.

9. The apparatus of claim 8 wherein said impedance component is activated to exert pressure of between approximately 30 and approximately 40 mm Hg.

10. The apparatus of claim 9 wherein said impedance component is activated to exert a maximum pressure of about 30 mm Hg.

11. The apparatus of claim 1 wherein said compression component is activated to exert a pressure of over about 40 mm Hg.

12. The apparatus of claim 1 further comprising a control unit to control the activation and deactivation of said impedance component and of said compression component.

13. The apparatus of claim 1 wherein the compression component is formable about the lower calf and foot to maximize venous return when the compression component is activated.

14. The apparatus of claim 1 wherein the compression component is shapeable about the lower calf and foot to enhance venous return when the compression component is compressed.

15. A method for enhancing return blood flow in a lower extremity to prevent thrombosis comprising the steps of:

a) impeding the venous blood flow at the proximal end of the lower extremity for a defined period of time thereby increasing venous fill in the lower extremity;

b) controlling, with a programmable control logic circuit, the impedance of return venous blood flow to promote maximum venous blood volume increase in the lower extremity;

c) independently releasing an impedance component in response to the programmable control logic circuit and increasing compression to the distal end of the lower extremity by a compression component in response to the programmable control logic circuit from the controller; and repeating steps a)-c) at a rate defined by the user.

16. The method of claim 15, further comprising the step of determining a maximal venous fill in response to impeding the venous blood flow.

17. The method of claim 15, wherein compressing a portion of the distal end of the lower extremity is initiated before, simultaneous with, or after release of, impedance of the venous blood flow at the proximal end of the lower extremity.

18. The method of claim 15 wherein the defined period of time comprises maintenance of a maximal venous fill for a defined period of time.

* * * * *